US007303165B2

(12) United States Patent
Comolli et al.

(10) Patent No.: US 7,303,165 B2
(45) Date of Patent: Dec. 4, 2007

(54) ROLL POSITIONING MECHANISM

(75) Inventors: Bruce C. Comolli, Tolland, CT (US); Thomas M. Jakowenko, Windsor Locks, CT (US)

(73) Assignee: Gerber Technology, Inc., Tolland, CT (US)

( * ) Notice: Subject to any disclaimer, the term of this patent is extended or adjusted under 35 U.S.C. 154(b) by 282 days.

(21) Appl. No.: 10/854,820

(22) Filed: May 27, 2004

(65) Prior Publication Data

US 2005/0002719 A1 Jan. 6, 2005

Related U.S. Application Data

(60) Provisional application No. 60/474,483, filed on May 30, 2003.

(51) Int. Cl.
*B65H 16/06* (2006.01)

(52) U.S. Cl. ..... 242/598.1; 242/596.1

(58) Field of Classification Search ..... 242/538, 242/538.2, 592, 596.1, 598, 598.1, 598.5; 400/614, 614.1
See application file for complete search history.

(56) References Cited

U.S. PATENT DOCUMENTS 2,860,841 A * 11/1958 Jacobsen ..... 242/563.1
3,028,943 A * 4/1962 Econom et al. ..... 400/615.1
4,222,212 A * 9/1980 Alderman ..... 52/749.12
4,234,136 A * 11/1980 Wenzel et al. ..... 242/598.1
5,187,532 A * 2/1993 McNew ..... 399/384
5,392,676 A * 2/1995 Drury ..... 83/455
2002/0126298 A1 9/2002 Galan et al.

FOREIGN PATENT DOCUMENTS

EP 1174281 A2 1/2002
JP 01028150 A * 1/1989
JP 04144860 A * 5/1992

* cited by examiner

*Primary Examiner*—Peter M. Cuomo
*Assistant Examiner*—Sang Kim
(74) *Attorney, Agent, or Firm*—Morgan & Finnegan, L.L.P.

(57) ABSTRACT

An apparatus for supporting rolls of work material for a printer includes first and second mandrel support plates each having a pair of mandrel supports spaced equidistant one from the other, along a length thereof. The first and second mandrel support plates are coupled to the printer for supporting opposing ends of a feeder roll mandrel and a take-up roll mandrel for the rolls of work material. One or both of the first and second mandrel support plates including adjustment means for adjusting the relative positions of the first and second mandrel support plates for alignment of the feeder and take-up roll mandrels one with the other.

11 Claims, 3 Drawing Sheets

ROLL POSITIONING MECHANISM

CROSS REFERENCE TO RELATED APPLICATIONS

This application claims priority to provisional patent application, Ser. No. 60/474,483 filed on May 30, 2003 and titled "Roll Positioning Mechanism", the disclosure of which is incorporated in its entirety herein by reference.

FIELD OF THE INVENTION

The present invention relates generally to printers and plotters that employ rolls of sheet-type work material fed through the printer. More particularly, the invention is directed to a roll positioning mechanism for adjusting the positions of the feeder and take-up rolls with respect to a platen forming part of the printer.

BACKGROUND OF THE INVENTION

In known printers, a single print head is mounted on a frame for movement transversely across and for printing on a piece of sheet-type work material. Generally, the print head prints onto the work material while the work material is stationary or moving. Where the printer employs roll-fed work material, the printer usually includes a mandrel plate or other support for supporting a feeder roll of work material as well as a take-up roll for the work material. When using a printer configured in this manner, the work material is fed through the printer from the feeder roll to the take-up roll.

The above-described printers generally include a frame, that carries a platen for supporting the work material as it is being printed and a print head responsive to commands issued from a controller. At least one mandrel support plate is usually attached to the frame for supporting the ends of a feeder roll mandrel and a take-up roll mandrel.

One problem associated with this type of printer is that often the mandrel support plates may not be positioned parallel to one another. This problem may be caused during assembly or during moving of the printer from one location to another. The frame could also be slightly twisted, causing the mandrel support plates to be out of alignment with respect to one another. If the mandrel support plates are not aligned substantially parallel to one another, the feeder and take-up rolls mandrels positioned on the mandrel support plates may also be out of alignment relative to each other. If the feeder and take-up roll mandrels are not substantially parallel one to the other, the work material may not feed through the printer properly which can cause the performance of the printer and the quality of work produced thereby to be adversely affected.

Based on the foregoing, it is the general object of the present invention to provide a roll positioning mechanism for a printer that overcomes the above-described problems and drawbacks present in the prior art.

SUMMARY OF THE INVENTION

The present invention is directed to a roll positioning mechanism for use with a printer for adjusting the relative positions of a feeder roll mandrel and a take-up roll mandrel for supporting work material for the printer. The roll positioning mechanism includes first and second mandrel support plates positioned at opposing ends of the printer and each having a pair of mandrel supports spaced apart along a length of the plates. One end of each of a feeder roll mandrel and a take-up roll mandrel can be positioned on each pair of mandrel supports. The feeder and take-up roll mandrels support rolls of sheet-type work material used by the printer.

The first and second mandrel support plates are attachable to a frame of the printer for supporting opposing ends of the feeder roll mandrel and the take-up roll mandrel. One or both of the first and second mandrel support plates includes adjustment means for aligning the two mandrel support plates substantially parallel one to the other so that the feeder and take-up roll mandrels when positioned on the mandrel support plates are substantially parallel with a platen or drive roll of the printer. Thus, the adjustment means provides for adjusting the tracking of the work material through the printer.

The adjustment means provided on one or both of the mandrel support plates can include means for rotation of the mandrel support plate about two perpendicular axes and slideable movement of the support plate in the direction of one of the axes. In one embodiment of the present invention, the first and second mandrel support plates are identical and include adjustment means as described above.

DETAILED DESCRIPTION OF THE PREFERRED EMBODIMENTS

Figure 1:
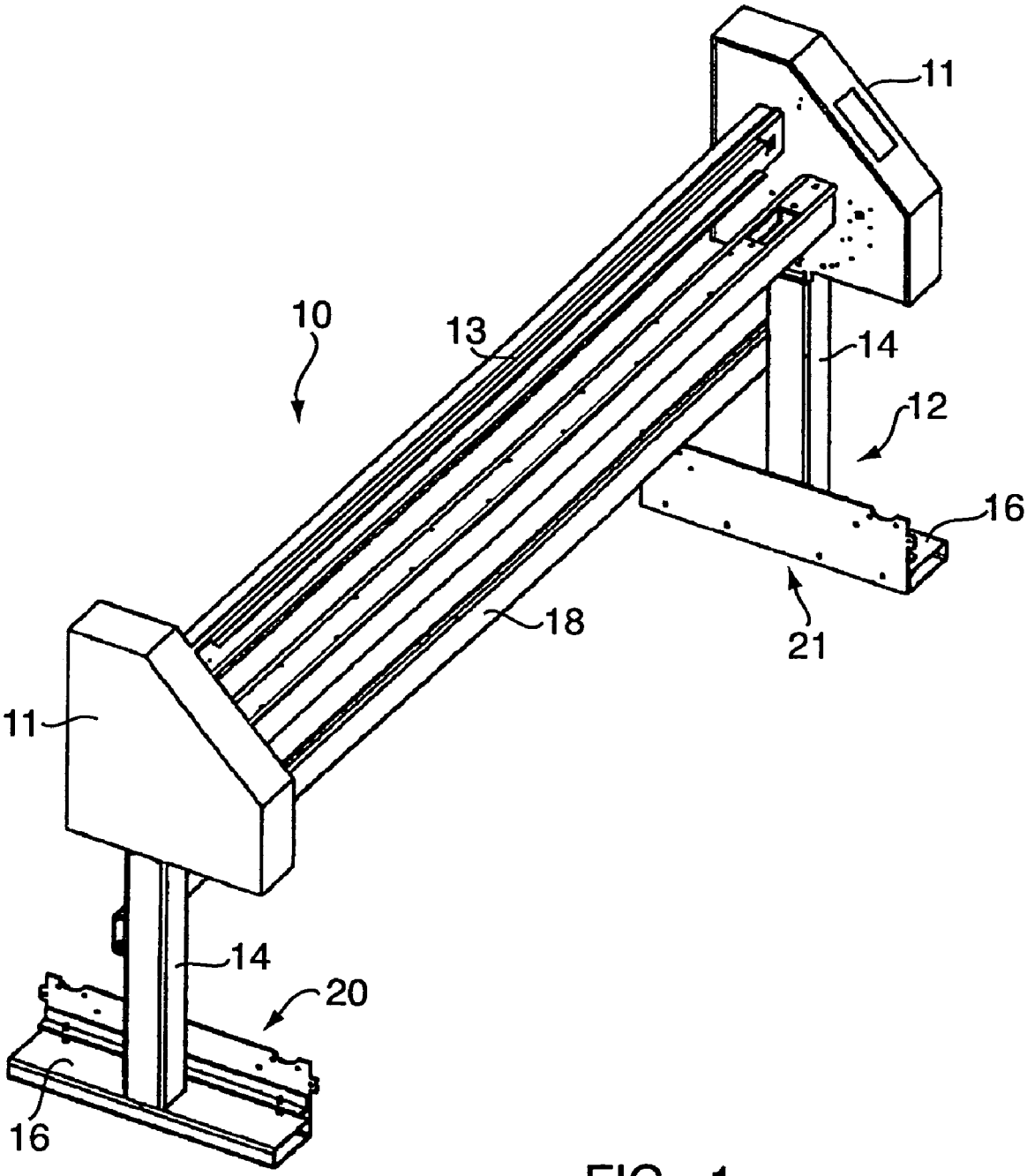
FIG. 1 is a perspective view of a plotter assembly including an embodiment of the present invention roll positioning mechanism.
Figure 2:
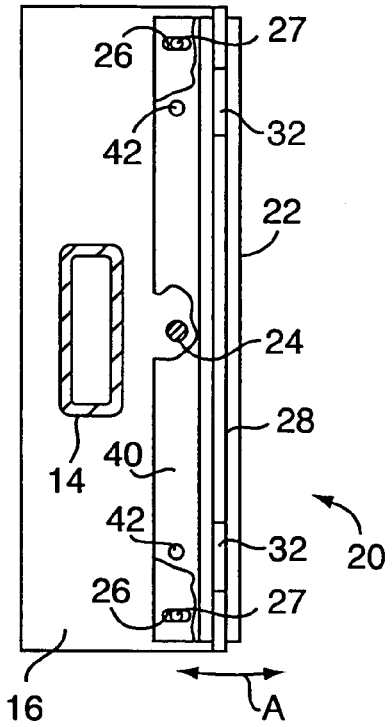
FIG. 2 is a partial cross-section and cut-away top view of an embodiment of the present invention mounted on the plotter of FIG. 1.

As shown in FIG. 1 a printer embodying the apparatus of the present invention is generally designated by the reference numeral 10, and includes end portions 11 and a frame generally designated by the reference numeral 12. A platen 13 and printer head (not shown) are supported between the end portions 11. The frame 12 includes vertical supports 14, base portions 16 and at least one cross member 18. The mandrel support plates of the present invention are generally designated by the reference numerals 20 and 21. In the embodiment shown, the mandrel support plates 20 and 21 are identical thus, the following description refers only to the mandrel support plate 20.

Referring to FIGS. 2–6, the mandrel support plate 20 according to the present invention includes a lower portion 22 coupled to the base portion 16 of the frame 12. The lower portion 22 is rotatable with respect to the base portion 16 about a first pin 24 in the direction of the line A shown in FIGS. 2 and 5. The lower portion 22 defines a pair of slots 26 for receiving screws 27 for fixing the position of the lower portion 22 relative to the base portion 16. The above-described first adjustment along the line A provides for alignment of the mandrel support plate 20 perpendicular to the platen 13 or drive roll (not shown). In another embodiment, the first pin 24 is removed wherein the lower portion 22 is slidable with respect to the base portion 16.

Figure 4:
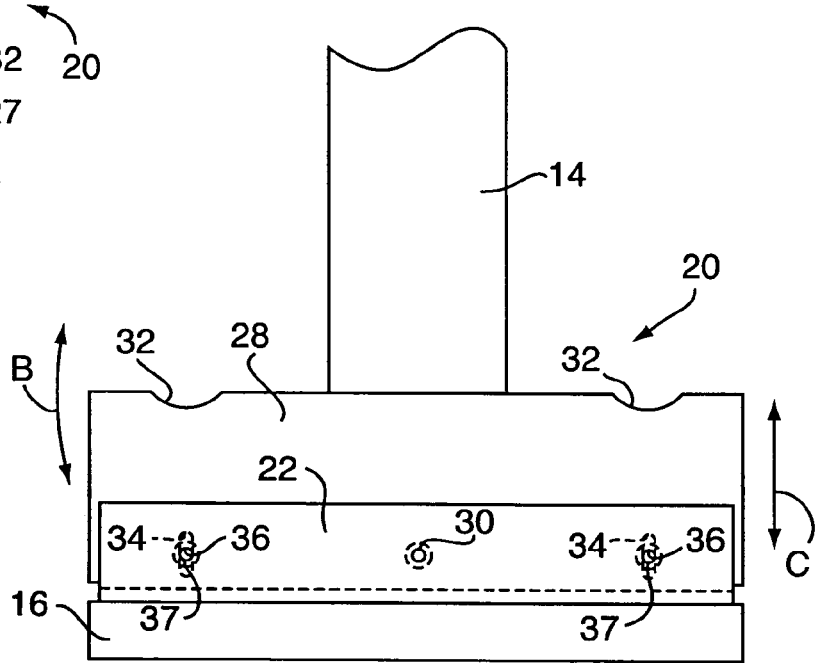
FIG. 4 is a front side view of the FIG. 2 embodiment of the present invention mounted on the plotter of FIG. 1.
Figure 3:
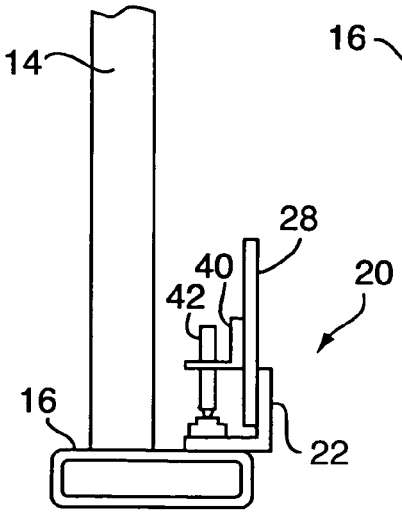
FIG. 3 is a partial end view of the FIG. 2 embodiment of the present invention mounted on the FIG. 1 plotter.
Figure 5:
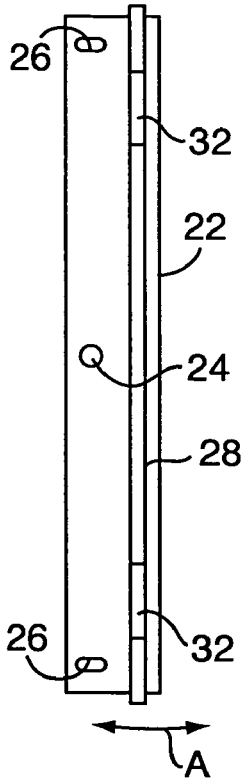
FIG. 5 is a top view of the FIG. 2 embodiment of the present invention.

An upper portion 28 of the mandrel support plate 20 is coupled to the lower portion 22 for rotation about a second pin 30 in the direction of a line B shown in FIG. 4. The upper portion 28 defines a pair of mandrel supports 32 formed as semi-circular cut-outs spaced apart along the length of the upper portion 28. The mandrel supports 32 each provide support for one end of one of the feeder and take-up rolls for work material for the plotter 10.

Figure 7:
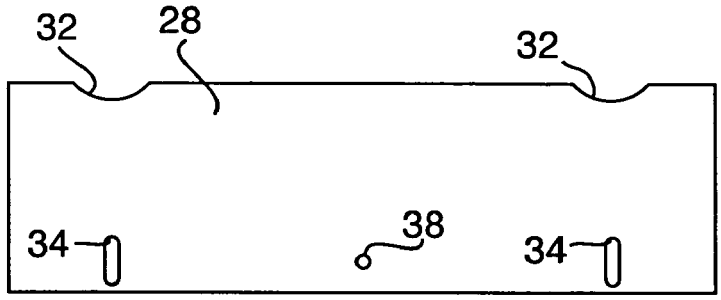
FIG. 7 is a front side view of the FIG. 2 embodiment of the present invention.
Figure 6:
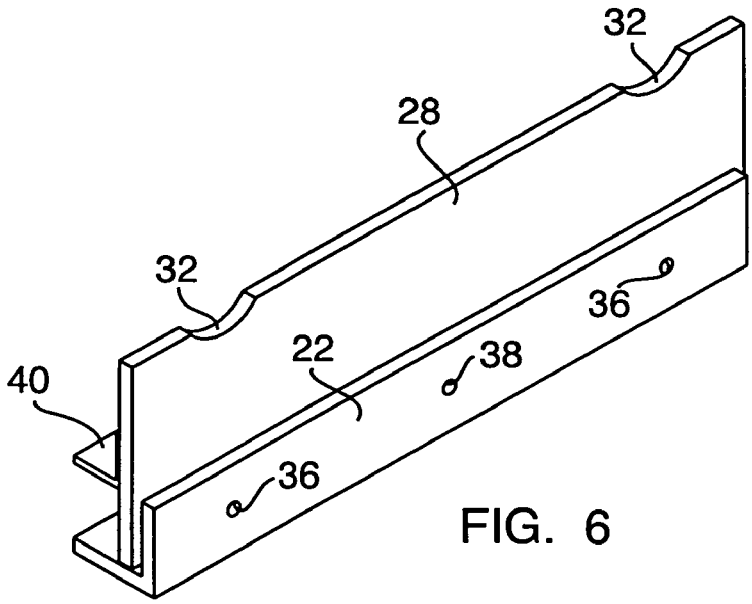
FIG. 6 is a perspective view of the FIG. 2 embodiment of the present invention.

Referring to FIGS. 6 and 7, the upper portion 28 defines slots 34 that correspond to apertures 36 defined by the lower portion 22 for receiving screws or other fasteners 37 to secure the position of the upper portion 28 relative to the lower portion 22. The upper portion 28 further defines an aperture 38 for receiving the pin 30. A bracket 40 attached to the upper portion 28 supports a pair of screw jacks 42 threadalbly engaged with the bracket 40 that provide for precision adjustment of the position of the upper portion 28 relative to the lower portion 22. The above-described second adjustment of the upper portion 28 in the direction of the line B, allows the mandrel support plates 20 and 21 positioned at opposing ends of the plotter 10 to be leveled with respect to one another. If necessary, the pin 30 can be removed so that the upper portion 28 can be raised towards the platen 13 in the direction C shown in FIG. 4.

During a set-up operation for the plotter 10, feeder and take-up rollers (not shown) for the plotter can be positioned on the mandrel supports 32 and adjusted with respect to each other and the platen 13 using the above-described adjustment means.

An adjustment procedure can include the following steps: 1) establishing that the feeder and take-up rolls are parallel one to the other and perpendicular to the platen 13 by adjusting the angular positions of the lower plate 22 on one or both of the mandrel support plates 20 and 21 about the pin 24. This first adjustment is represented by the line A in FIGS. 2 and 5; and 2) Adjust the elevation of the feeder and take-up rolls to level the rolls with respect to each other using the jack screws 42. This second adjustment is represented by the lines B or C shown in FIG. 4. Thus, the tracking of the work material through the plotter 10 can be adjusted via the above-described steps.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. An apparatus for use with a printer for adjusting the relative positions of a feeder roll mandrel and a take-up roll mandrel, the feeder roll mandrel and take-up roll mandrel for supporting rolls of sheet-type work material used in the printer, the apparatus comprising:

first and second mandrel support plates configured for attachment to a frame of a printer, each said mandrel support plate defining a pair of mandrel supports spaced approximately equidistant one from the other along a length of the mandrel support plate, said first and second mandrel support plates for supporting opposing ends of a feeder roll mandrel and a take-up roll mandrel that support rolls of work material;

at least one of said first and second mandrel support plates includes adjustment means for aligning the relative positions of said first and second mandrel support plates to align said feeder and take-up roll mandrels one with the other;

said adjustment means is defined in part by a first portion of one of said first and second mandrel support plates being movably coupled to said frame for adjustment of the position of said first portion relative to said frame in a first direction, and a second portion movably coupled to said first portion for adjustment of the position of said second portion relative to said first portion in a second direction; and said first portion is coupled to said frame for rotation about a first axis.

2. The apparatus as defined in claim 1 farther comprising a locking means for securing the position of the first portion relative to the frame.

3. The apparatus as defined in claim 2 wherein the locking means includes at least one slot defined by the first portion, a corresponding hole defined by the frame, and a fastener extending through the slot and secured in the hole for fixing the position of the first portion relative to the frame.

4. The apparatus as defined in claim 1 farther comprising a locking means for securing the position of the second portion relative to the first portion.

5. The apparatus as defined in claim 4 wherein the locking means includes at least one slot defined by one of the first and second portions, a corresponding hole defined by the other of the first portion and second portions, and a fastener extending through the slot and secured in the hole for fixing the position of the second portion relative to the first portion.

6. The apparatus as defined in claim 1 wherein said second portion is rotatably coupled to said first portion for rotation about a second axis, said second axis being substantially perpendicular to said first axis.

7. The apparatus as defined in claim 1 wherein said first portion is slidably coupled to said frame for adjusting the position of said first portion relative to said frame.

8. The apparatus as defined in claim 1 wherein said second portion is slidably coupled to said first portion for adjusting the position of said second portion relative to said first portion.

9. The apparatus as defined in claim 1 farther comprising at least one screw jack for adjusting the position of the second portion relative to the first portion.

10. The apparatus as defined in claim 1 farther comprising a first pin wherein said first portion is coupled to said frame for rotation about said first pin.

11. The apparatus as defined in claim 10 further comprising a second pin, wherein said second portion is rotatably coupled to said first portion for rotation about said second pin, said second pin being substantially perpendicular to said first pin.

* * * * *